US007121299B2

(12) United States Patent
Lumello

(10) Patent No.: US 7,121,299 B2
(45) Date of Patent: Oct. 17, 2006

(54) REGULATOR VALVE WITH FLOW INDICATOR FOR A HOT-WATER HEATING SYSTEM

(75) Inventor: Carlo Lumello, Valduggia (IT)

(73) Assignee: Onda Engineering System S.r.l., Vercelli (IT)

( * ) Notice: Subject to any disclaimer, the term of this patent is extended or adjusted under 35 U.S.C. 154(b) by 396 days.

(21) Appl. No.: 10/726,630

(22) Filed: Dec. 4, 2003

(65) Prior Publication Data

US 2004/0108002 A1 Jun. 10, 2004

(30) Foreign Application Priority Data

Dec. 4, 2002 (IT) ..... TO2002A1060

(51) Int. Cl.
*F16K 37/00* (2006.01)
*G01F 1/28* (2006.01)

(52) U.S. Cl. ..... 137/552; 137/559; 251/83; 73/861.74

(58) Field of Classification Search ..... 137/552, 137/559; 251/82, 83; 73/861.71, 861.74
See application file for complete search history.

(56) References Cited

U.S. PATENT DOCUMENTS

| | | | | |
|---|---|---|---|---|
| 1,215,129 A | | 2/1917 | Edlich | |
| 1,855,044 A | * | 4/1932 | Conrader et al. | 73/861.54 |
| 2,217,330 A | * | 10/1940 | Buttner | 251/83 |
| 2,321,679 A | | 6/1943 | Houston | |
| 3,744,313 A | * | 7/1973 | Thompson | 73/861.54 |
| 3,881,354 A | * | 5/1975 | Block | 73/861.71 |
| 5,890,515 A | * | 4/1999 | Spiess et al. | 137/552 |
| 6,089,263 A | * | 7/2000 | Dumser | 137/552 |
| 6,089,264 A | | 7/2000 | Spiess | |
| 6,119,724 A | * | 9/2000 | Cazzaniga | 137/552 |
| 6,325,098 B1 | * | 12/2001 | Motta et al. | 73/861.74 |
| 6,736,165 B1 | * | 5/2004 | Bender | 137/883 |

FOREIGN PATENT DOCUMENTS

| | | | |
|---|---|---|---|
| DE | 64 617 C | | 2/1892 |
| DE | 3509718 A1 | * | 9/1986 |
| DE | 297 04 960 U1 | | 5/1998 |
| DE | 201 17 196 U1 | | 3/2002 |
| FR | 2731492 A1 | * | 9/1996 |
| WO | WO 03/089844 | * | 10/2003 |

* cited by examiner

*Primary Examiner*—John Rivell
(74) *Attorney, Agent, or Firm*—Sughrue Mion, PLLC

(57) ABSTRACT

The valve includes an intake duct (13) for conveying water into the valve, an externally projecting tubular body (20) of a transparent with an internal cavity (21) and a flow indicator rod (40), slidable inside the valve, with a lower portion in the intake duct (13) and an upper indicator portion in the internal cavity (21) of the transparent body (20). The upper, indicator portion has a first upper area (46) able to indicate no water is flowing and a second, lower area (47) able to indicate that water is flowing through the intake duct (13). The valves includes also a rotatable knob (18) for adjusting the flow of water through the intake duct (13) by means of a shutter, which has the shape of a conical head (41) and which corresponds to the lower portion of the indicator rod (40), and a tubular element (30) coupled axially by threaded means (42) to the transparent body (20) which is secured to the knob (18) in order to adjust upwards or downwards the position of an abutment surface (48) of the rod (40) and thereby cause the closure or degree of opening of the valve.

9 Claims, 2 Drawing Sheets

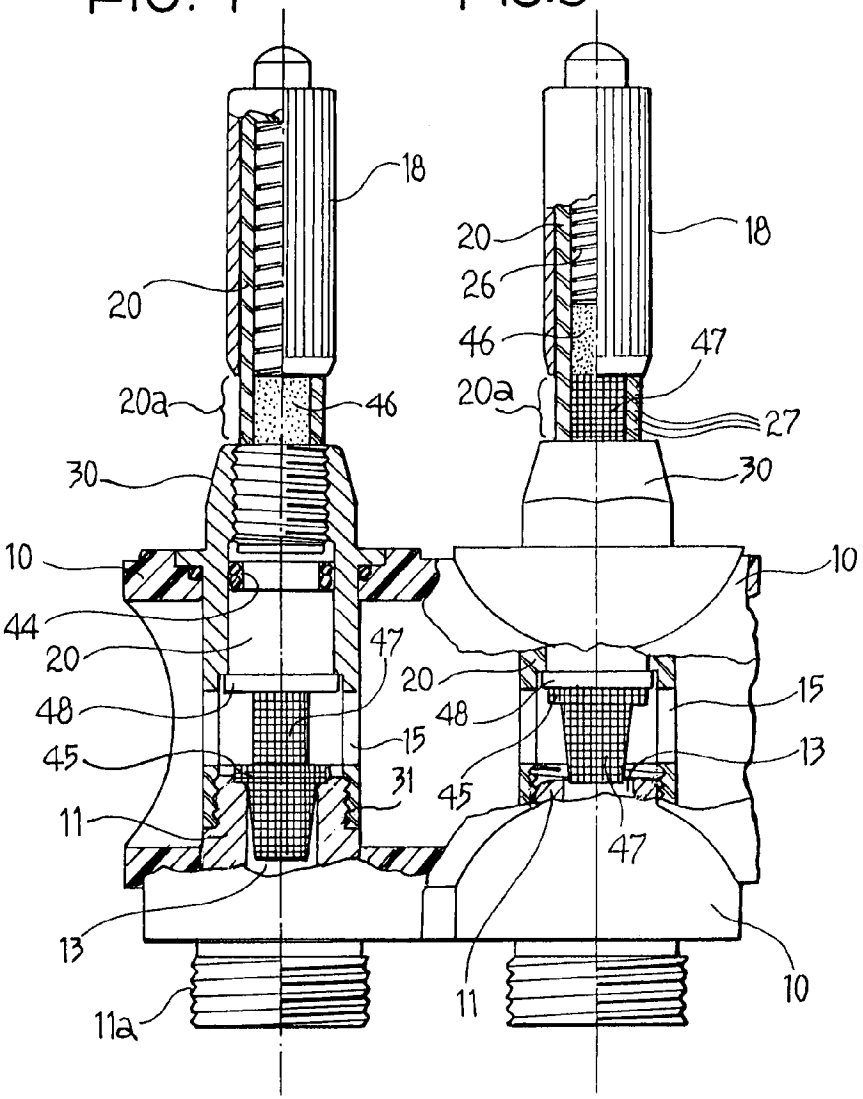
FIG. 4
FIG. 5
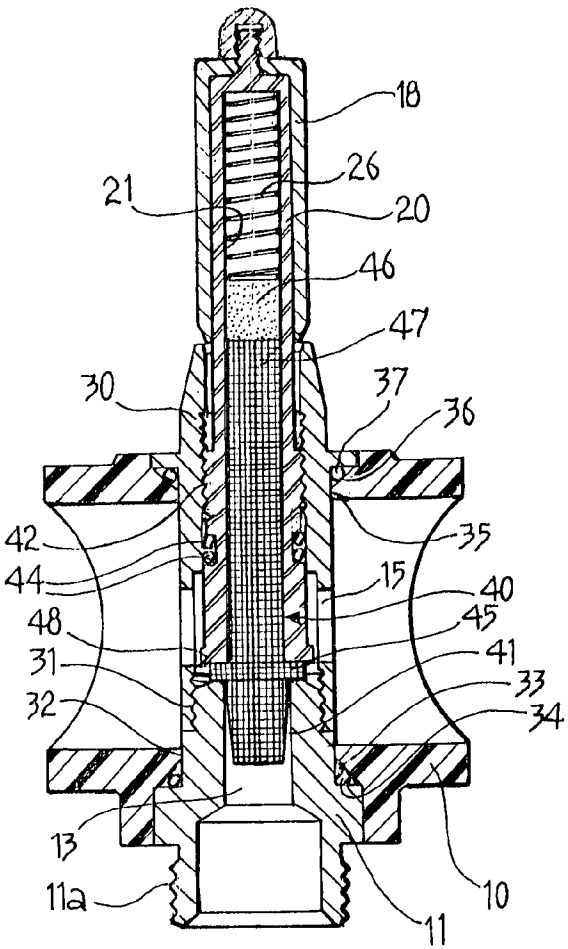
FIG. 3

REGULATOR VALVE WITH FLOW INDICATOR FOR A HOT-WATER HEATING SYSTEM

The present invention relates to a regulator valve with a flow indicator for a hot-water heating system.

FIGS. 1 and 2 of the appended drawings show a regulator valve of a known type with an instantaneous flow display. Valve units of this type are mounted side by side in horizontal batteries which act as manifolds and water return flow dividers in a heating system.

The modular valve unit of FIG. 1 includes a hollow body 10 in the general shape of a sleeve open at each end and formed in one piece of moulded plastics material for coupling to other similar sleeves in order to make up a water return manifold. A lower pipe coupling 11 is fitted in the body 10 with external threading for securing it to a pipe 12 for returning water to the manifold. Inside the body 10 a transverse duct 13 is formed which widens into a cup-shape formation 14 with an outlet aperture 15. A rotatable cylindrical shutter 16 with an oblique base 17 is housed in the cup-shape formation 14. The cylindrical shutter 16 is rotatable by means of an upper knob 18 and has an oblique O-ring 19 providing a seal against the cylindrical inner wall of the cup-shape formation 14. By rotating the shutter 16 by means of the knob 18, the outlet 15 is opened, partially opened or closed according to the angular position of the shutter 16.

The rotatable shutter 16 is made of a transparent material and has a tubular portion 20 at the top with an axial central cavity 21. The cavity 21 opens at the bottom of the shutter into a flared hollow 22. An indicator rod 23 is slidable axially in the cavity 21 with a disc or plate 24 at the bottom in the transverse duct 13 and a head at the top visible from outside through the tubular portion 20 of the transparent shutter 16. When the valve is at least partially open, as shown in FIG. 1, water from the pipe 12 flows through the transverse duct 13 and exits from the outlet 15, urging the disc 24 and the indicator rod 23 upwards, against the resilient force of a spring 26 interposed between the disc 24 and the shutter 16. The flow of water through the transverse duct 13 causes the indicator rod 23 to rise proportionately to the rate of flow.

As shown in FIG. 2, the upper head 25 of the movable rod 23 is positioned along a graduated scale displayed on a plate 27 and makes it possible to read the instantaneous rate of flow through the duct 13.

Although conventional flow regulator valves such as that shown in FIGS. 1 and 2 make it possible to read the instantaneous flow rate, they do not enable a user to appreciate immediately whether, if there is no water flowing, this is due to the valve being closed or to the fact that the heating system is not working.

A general object of the present invention is to provide a flow regulator valve with an improved flow rate indicator operable to overcome the limitations described above in relation to the prior art.

Another object of the invention is to provide a reliable and efficient valve which is both simple and economical to manufacture.

These and other objects, which will be understood better later, are achieved according to the invention by providing a regulator valve with flow indicator as defined in the appended Claims.

A preferred but not limitative embodiment of a regulator valve according to the present invention will now be described with reference to the appended drawings, in which:

FIG. 3 is an axially sectioned view of a regulator valve with a flow indicator according to the present invention, in a closed position;

FIG. 4 is a partially axially sectioned view of the valve of FIG. 3 in a completely open position with no water flow; and FIG. 5 is a partially axially sectioned view of the valve of FIGS. 3 and 4 in an open position with a through flow.

Figure 1:
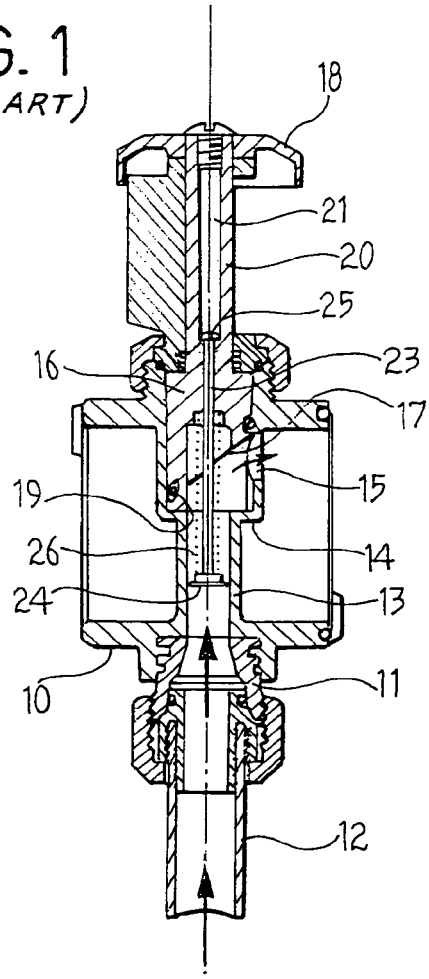
FIG. 1 (PRIOR ART)
FIG. 1 is an axially sectioned view of a regulator valve unit with a known instantaneous flow display.
Figure 2:
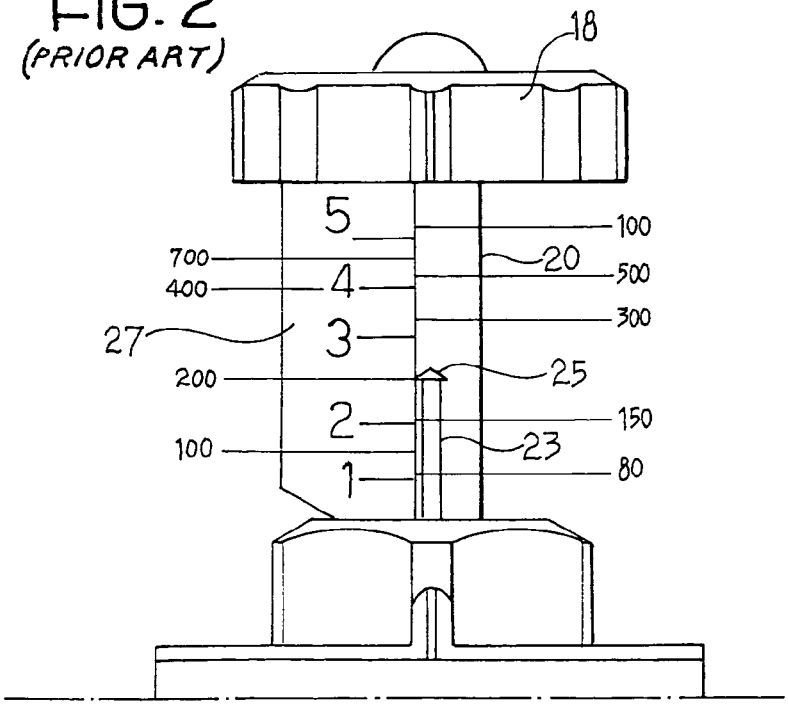
FIG. 2 (PRIOR ART)
FIG. 2 is a front view, on an enlarged scale, of a detail of the conventional valve of FIG. 1.

With reference to FIG. 3, and using wherever possible the same reference numbers used in FIGS. 1 and 2 to indicate identical or corresponding parts, a regulator valve according to the present invention is mounted in a portion 10 of a return manifold, of plastics material, in a hot-water heating system. The manifold 10 can consist either of an elongate single unit, shared by several adjacent valve units or of a modular hollow sleeve element open at each end for mounting end-to-end with similar modular elements, as in the case of the valve illustrated in FIG. 1.

The valve includes a first metal lower tubular element 11 and a second metal upper tubular element 30, both fitted transversely to the manifold or sleeve 10 and mechanically coupled to each other at a threaded joint 31. The lower tubular element 11 is inserted through a lower aperture 32 in the manifold 10, where a conical surface 33 is formed which has a resiliently compressible annular element 34 (O-ring) sealably engaged against it. The lower tubular element 11 forms an intake duct 13 which can be closed by the lower conical head 41 of a shutter-indicator rod 40, as will be described more fully later. The outside of the lower tubular element 11 is threaded at 11*a* for connection to a pipe (not shown) for introducing water into the duct 13.

The upper tubular element 30 is inserted into the sleeve 10 through an upper aperture 35, near which a conical surface 36 is formed with an interposed resiliently compressible annular element 37 (O-ring). When the tubular elements 11 and 30 are screwed together they compress the O-rings 34, 37 thereby ensuring an effective seal between the plastics material of the manifold 10 and the metal constituting the tubular elements 11 and 30.

The tubular element 30 has an opening 15 for the outflow of water coming from the intake duct 13.

A transparent tubular body 20 is housed in the upper tubular element 30 and screwed thereto at 42 in such a way that its height can be adjusted between a completely lowered or closed position (see FIG. 3) and a completely raised or open position (see FIGS. 4 and 5), and intermediate, partially open positions (not shown). The transparent body 20 is raised or lowered manually by turning a cylindrical knob 18, of a non-transparent material, which covers the upper portion of the transparent body 20 and is secured thereto. The transparent tubular body 20 has an axial internal cavity 21, with a constant section, slidably housing the shutter-indicator rod 40 and a biasing spring 26. A pair of annular seals 44 provides an airtight seal between the transparent body 20 and the upper metal tubular element 30.

The shutter-indicator rod 40 forms a radially projecting flange 45 near the lower conical head 41. At the top, the rod 40 has a preferably blue portion 46, with a preferably red portion 47 beneath this.

The valve of the present invention operates as follows.

Starting from the configuration illustrated in FIG. 3, the valve is completely closed. By turning the rotatable knob 18, the transparent tubular body 20 has been lowered in the upper tubular element 30 and the bottom 48 of the body has urged the flange 45 against the top outlet mouth of the intake duct 13, closing it. In the fully closed condition of FIG. 3, the shutterer-indicator rod 40 is not visible from outside.

By turning the rotatable knob 18, the transparent tubular body 20 can be raised in an adjustable manner so as to allow water to flow through the duct 13 at a desired rate; in FIG. 4 the transparent body 20 is in its fully raised position and a portion 20*a* of the transparent body 20 is visible from outside.

If, as shown in FIG. 4, the valve is open but for some reason no water is flowing through it, the stopper-indicator rod 40 remains in its fully lowered position, in which its blue portion 46 is visible through the exposed transparent portion 20*a*. A user is thus able to determine immediately that the heating system is not working despite the valve being open.

If, on the other hand, the heating system is working and the valve is at least partially open, the flow through the duct 13 pushes the shutter-indicator rod 40 upwards, positioning the flange 45 thereof so it bears against the bottom 48 of the transparent tubular body 20, against the opposing resilient force of the spring 26.

A graduated scale 27 is formed on the exposable portion 20*a* of the transparent body 20 to identify adjustment levels (1 to 3 or 1 to 5, for example) of the flow rate (50, 100, 150, 200 litres/hour, for example).

A user can thus determine immediately the value of the flow rate to which the system has been set (generally in dependence on the calories/hour to be supplied in a particular environment) and know immediately whether water is flowing through or not, according to the colour (blue or red) seen through the transparent portion 20*a*.

As will also be appreciated, the valve according to the present invention combines the functions of shutter and indicator in a single element. Conical shutters, which are known per se, offer reliable performance and enable flow to be regulated precisely.

What is claimed is:

1. A regulator valve with a flow indicator for a hot-water heating system, comprising:

an intake duct (13) for conveying water into the valve;

a tubular body (20), projecting externally, of a material which is at least partially transparent and has an internal cavity (21);

a flow indicator rod (40), slidable inside the valve, with a lower portion housed in the intake duct (13) and an upper indicator portion housed in the internal cavity (21) of the transparent body (20) wherein the indicator portion has a first upper area (46) for indicating that no water is flowing and a second, lower area (47) for indicating that water is flowing through the intake duct (13);

a rotatable knob (18) for regulating the flow of water through the intake duct (13) by means of a shutter, which has the shape of a conical head (41) and which corresponds to the lower portion of the indicator rod (40);

a tubular element (30) of the valve coupled axially by threaded means (42) to the transparent body (20) which is secured to the knob (18) so as to adjust the position of an abutment surface (48) of the rod (40) and thereby control the aperture of the valve;

the valve being capable of taking the following operational conditions:

a closed condition in which the transparent body (20) is lowered so as to hold the rod (40) in a position closing the duct (13);

an at least partially open position, in which the transparent body (20) is raised so as to allow the rod (40) to reach a raised position, when water is flowing through the duct (13) and the second portion (47), indicating this flow, is visible through the transparent body (20) and a lowered position, when no water is flowing through the duct (13) and the first area (46), indicating an absence of water, is visible through the transparent body (20).

2. The regulator valve of claim 1, wherein the knob (18) includes a cover of a non-transparent material enclosing an upper portion of the transparent body (20) in such a way that, when the valve is at least partially open, the cover reveals a portion (20*a*) of the transparent body (20) through which at least one of the aforesaid first (46) and second (47) areas of the upper, indicator portion of the rod (40) is visible, in dependence on the vertical position of the rod.

3. The regulator valve of claim 2, wherein in the closed position of the valve, the cover (18) encloses substantially the entire externally projecting portion of the transparent body (20).

4. The regulator valve of claim 1, wherein the conical head portion (41) and the indicator portion (46, 47) are formed in one piece.

5. The regulator valve of claim 1, wherein the cavity (21) of the transparent body (20) has a constant cross section.

6. The regulator valve of claim 1, wherein a resilient biasing element (26) is housed in the internal cavity (21) of the transparent body (20) interposed between this transparent body and the shutter-indicator rod (40) for urging the shutter indicator rod into its lowered position.

7. The regulator valve of claim 1, wherein the intake duct (13) is formed of a first, lower metal tubular element (11) coupled mechanically to a second, upper metal tubular element (30) in which the transparent body (20) is secured by threaded means.

8. The regulator valve of claim 1, wherein the first area (46) indicating no water is flowing is of a colour tending towards blue and the second area (47) indicating water is flowing is of a colour tending towards red.

9. The regulator valve of claim 1, wherein it is mounted in a hollow sleeve-like body (10) composing or constituting a return manifold in a water-based heating system.

* * * * *